United States Patent [19]

Clements et al.

[11] 3,999,668

[45] Dec. 28, 1976

[54] OXIDATION RETARDANT SYSTEM FOR STORAGE OF HOTMIX ASPHALT

[75] Inventors: Jack T. Clements, Raytown, Mo.; Stanley A. Reigel, Overland Park, Kans.

[73] Assignee: Standard Havens, Inc., Kansas City, Mo.

[22] Filed: July 16, 1975

[21] Appl. No.: 596,528

[52] U.S. Cl. ..... 214/17 CA; 222/146 R

[51] Int. Cl.[2] ..... B65G 65/42

[58] Field of Search ..... 214/17 R, 17 C, 17 A, 214/17 B, 17 CA, 17 DB, 18 R; 222/52, 53, 146 R, 504; 52/192; 49/221

[56] References Cited

UNITED STATES PATENTS

| | | | |
|---|---|---|---|
| 3,251,292 | 5/1966 | Vaughan | 214/17 CA |
| 3,301,441 | 1/1967 | Werner et al. | 222/146 R |
| 3,348,739 | 10/1967 | Brock | 222/146 R |
| 3,386,206 | 6/1968 | Loveless | 49/221 |
| 3,532,252 | 10/1970 | Brock | 222/52 |
| 3,623,627 | 11/1971 | Bolton | 49/221 |
| 3,820,687 | 6/1974 | Brock | 222/53 |

*Primary Examiner*—Trygve M. Blix
*Assistant Examiner*—Jesus D. Sotelo
*Attorney, Agent, or Firm*—Lowe, Kokjer, Kircher, Wharton & Bowman

[57] ABSTRACT

For retarding oxidation of hotmix asphalt, an inert gas injection system for a storage bin equipped with a self-sealing intake door and pressure equalizing valves. Inert gas is periodically introduced into the bin by electrically timed control.

4 Claims, 7 Drawing Figures

OXIDATION RETARDANT SYSTEM FOR STORAGE OF HOTMIX ASPHALT

BACKGROUND AND SUMMARY OF THE INVENTION

This invention relates to the temporary storage of hotmix asphalt. More particularly, this invention relates to hotmix storage facilities equipped with a system for injecting inert gas interiorly of the bin to prevent oxidation of hotmix asphalt.

The advantages associated with the temporary storage of hotmix asphalt have long been recognized in the industry. Such storage permits a readily available supply of asphalt for discharge to delivery trucks which carry the material to a job site. Thus truck waiting time at the asphalt plant, along with the attendant costs thereof, is greatly minimized.

Experience shows that oxidation of the asphalt occurs during storage which represents product degradation and also presents unloading difficulties. To minimize such harmful oxidation, it is known to provide an inert gas interiorly of the bin as a "blanket" over the asphalt to prevent contact with air.

U.S. Pat. No. 3,834,595 issued Sept. 10, 1974 to Brock et al. and U.S. Pat. No. 3,820,687 issued June 28, 1974 to Brock are representative of developments in the state of the art of providing an inert gas atmosphere in an asphalt storage bin. Both references teach the use of inflatable bladders to seal the openings of the storage bin to provide a completely sealed chamber in which an inert gas is contained. The Brock U.S. Pat. No. 3,820,687 prevents asphalt oxidation by circulating air within the bin through a converter in which burning carbon converts the oxygen present in the air to inert carbon dioxide.

The inert gas systems of the prior art are characterized as an inert gas continuously supplied to a tightly sealed storage bin. Costly and complex equipment is required to carry out this intent. Our invention, on the other hand, departs dramatically from such concepts. There is a need for a simple, inexpensive and reliable system to retard oxidation of hotmix asphalt in a storage bin. The primary goal of this invention is to meet this need.

More particularly, an object of this invention is to provide a top closure door for an asphalt storage bin which is self-sealing in a closed position, but which is quickly opened to admit asphalt fed from the production plant.

Another object of the invention is to provide convenient discharge of hotmix from a storage bin equipped with an inert gas system and to eliminate the creation of a partial vacuum in the top of the storage bin when material is discharged.

An additional object of the invention is to provide an inert gas injection system to effectively retard oxidation of asphalt within the storage bin while minimizing the demand on the inert gas supply itself. In other words, economy of operation is of paramount importance. Minimal inert gas demands are achieved through a unique systems control which electrically times the injection of inert gas.

Another object of the invention is to provide an inert gas system of the character described and which functions trouble-free with little maintenance and repair.

Other and further objects of the invention, together with the features of novelty appurtenant thereto, will appear in the course of the following description.

DESCRIPTION OF THE DRAWINGS

In the accompanying drawings, which form a part of the specification and are to be read in conjunction therewith, and in which reference numerals are employed to indicate like parts of the various views;

Referring now to the drawings in greater detail, FIG. 1 shows typical storage facilities for hotmix asphalt. These facilities include a storage bin 10 consisting of an upper cylindrical tank 10*a* which terminates at its lower end in a frusto-conical hopper 10*b*. The bin is supported above the ground by a plurality of stilt legs 10*c* to form a "drive through" 10*d* in which trucks can be positioned. The asphalt material may then be discharged through a central opening in the hopper section 10*b* when the clam gates 10*e* are retracted.

The temporary asphalt storage facilities also include an inclined conveyor 11 which delivers hotmix at ground level from the asphalt production plant (not shown) to the top of the storage bin.

Figure 1:
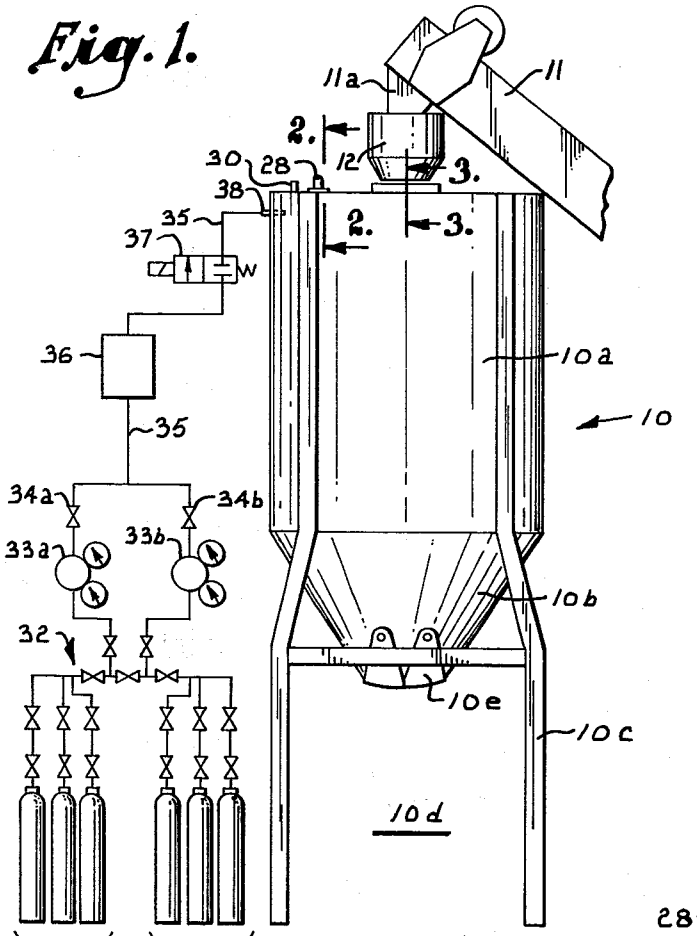
FIG. 1 is a side elevational view of an asphalt storage bin equipped with a schematically illustrated inert gas system in accordance with a preferred embodiment of the invention.

Although not essential to the practice of the present invention, FIG. 1 also illustrates a pulse feeder 12 mounted atop the storage bin. The pulse feeder 12 collects hotmix delivered through the dumping spout 11*a* of the inclined conveyor and then, when its clam gates 12*a* (FIG. 4) are retracted, intermittently discharges the material as a large uniform stream to the storage bin 10 in order to prevent segregation of the aggregate from the hotmix. Additional details of construction of the pulse feeder 12 are contained in U.S. Pat. No. 3,777,909 issued Dec. 11, 1973 to Rheinfrank which is incorporated herein by reference.

With reference to FIGS. 3–6, the top of the storage bin 10 is closed with a circular top plate or roof 13. Disposed through the top plate 13 is a rectangular delivery port 14 through which hotmix may be delivered to the storage bin 10 from either the pulse feeder 12 or directly from the dumping spout 11*a* of the conveyor 11 when a pulse feeder is not employed. Around the perimeter of the intake port 14 are vertical flange walls 15*a–d*. Opposed side walls 15*a–b* are tapered from the front wall 15*c* to a rear wall 15*d* which is of lower height than the front wall 15*c*. Thus the edges of the flange walls 15*a–d* lie in a plane which is inclined with respect to the horizontal surface of the top cover plate 13.

Figure 3:
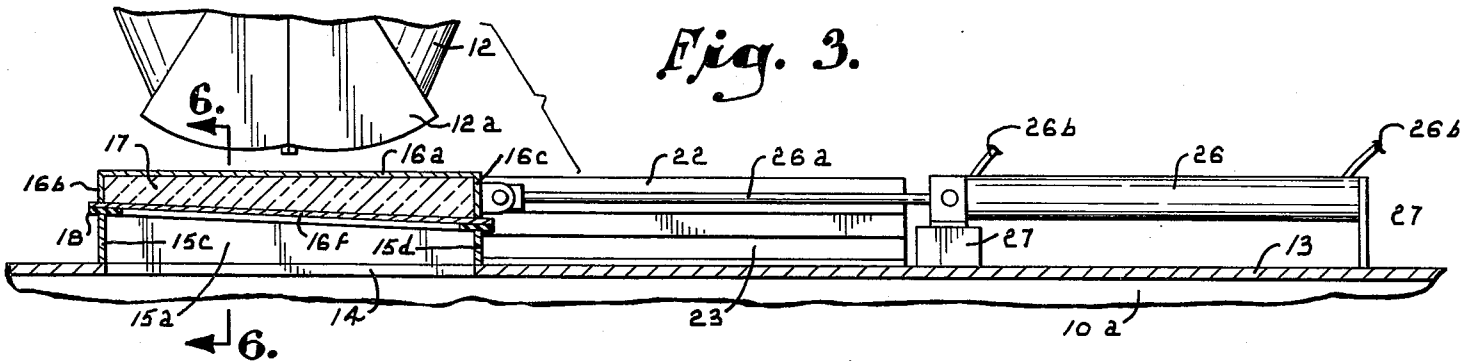
FIG. 3 is an enlarged side elevational view of the top closure door shown in the closed position and taken along line 3—3 of FIG. 1 in the direction of the arrows.

Covering the foregoing intake port 14 is a movable closure door 16 now to be described in detail. The door 16 itself forms a trapezoidal prism having an upper horizontal panel 16*a*, forward and rearward vertical walls, 16*b–c*, side walls 16*d–e* tapered complementary to the side flange walls 15*a–b* of the intake port, and a bottom inclined panel 16*f*. The interior space defined by the foregoing panels and walls of the closure door 16 is filled with insulation material 17 to minimize heat leak. A resilient gasket 18 is secured at the peripheral margin of the closure door bottom panel 16*f* to overlie the flange walls 15*a–d* when the door 16 is closed as shown in FIG. 3.

Projecting outwardly from the tapered side walls 16*d–e* are a plurality of shafts 19 on which are mounted bearing members 20 with rotatable notched wheels 21. Extending along each side of the tapered side flange walls 15*a–b* and rearwardly thereof are track assemblies 22 mounted to the top plate 13 of the bin by L-shaped brackets 23.

Figure 6:
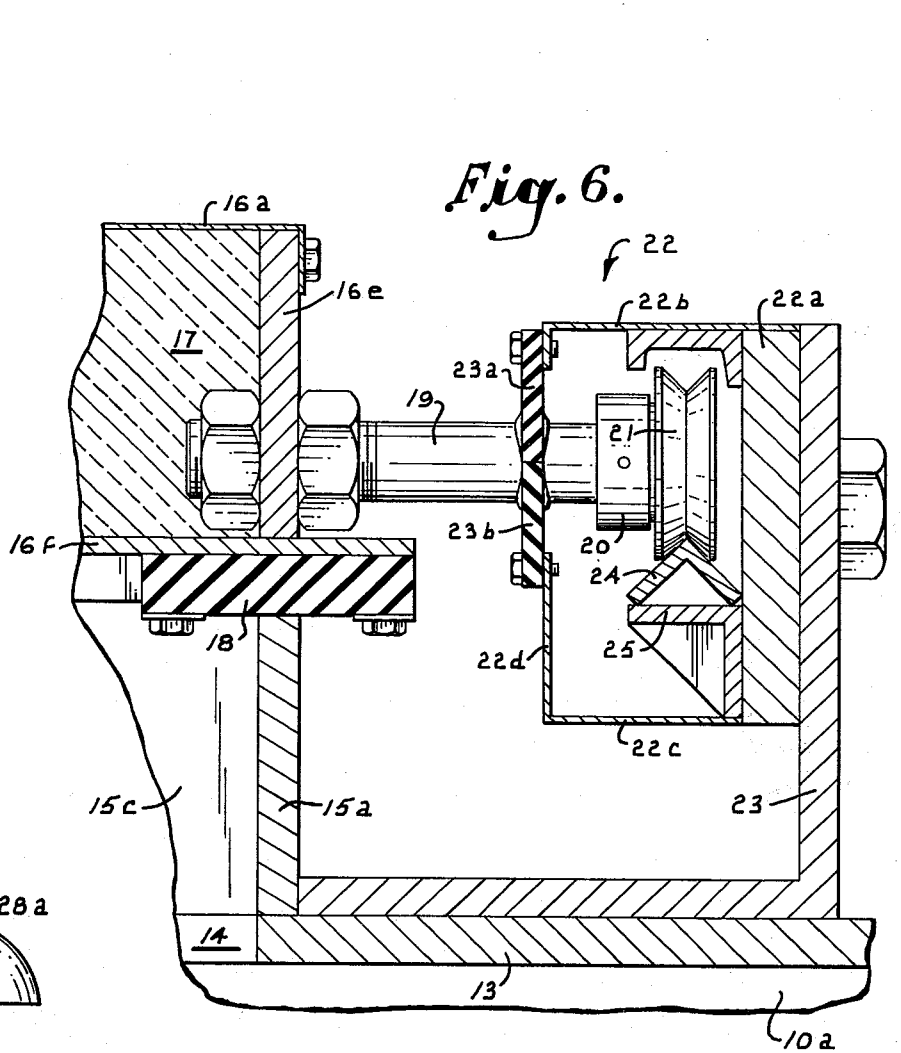
FIG. 6 is an enlarged sectional view of one support track for the closure door taken along line 6—6 of FIG. 3 in the direction of the arrows.

Referring particularly to FIG. 6 for the details of construction, each track assembly 22 includes a box-like housing having a rear wall 22*a* secured to the L brackets 23, top and bottom walls 22*b–c*, and a partial front wall 22*d* which extends upwardly from the bottom wall 22*c* but does not meet the top wall 22*b*. The ends of the track housing are enclosed by suitable end plates 22*e*.

Covering the elongate opening between the top edge of the partial front wall 22*d* and the top wall 22*b* is a flexible shield having an upper strip 23*a* connected to the top wall 22*b* of the track housing and a lower strip 23*b* fastened to the front wall 22*d*. The inner edges of the shield strip 23*a–b* thus meet in an abutting seam to prevent spilled or deflected hotmix from entering the track housing. Nevertheless, the seam is easily penetrated by the shafts 19 projecting from the closure door 16 and permit longitudinal movement of the shafts 19 although the shield strips 23*a–b* deformably seal against each individual shaft 19.

Figure 4:
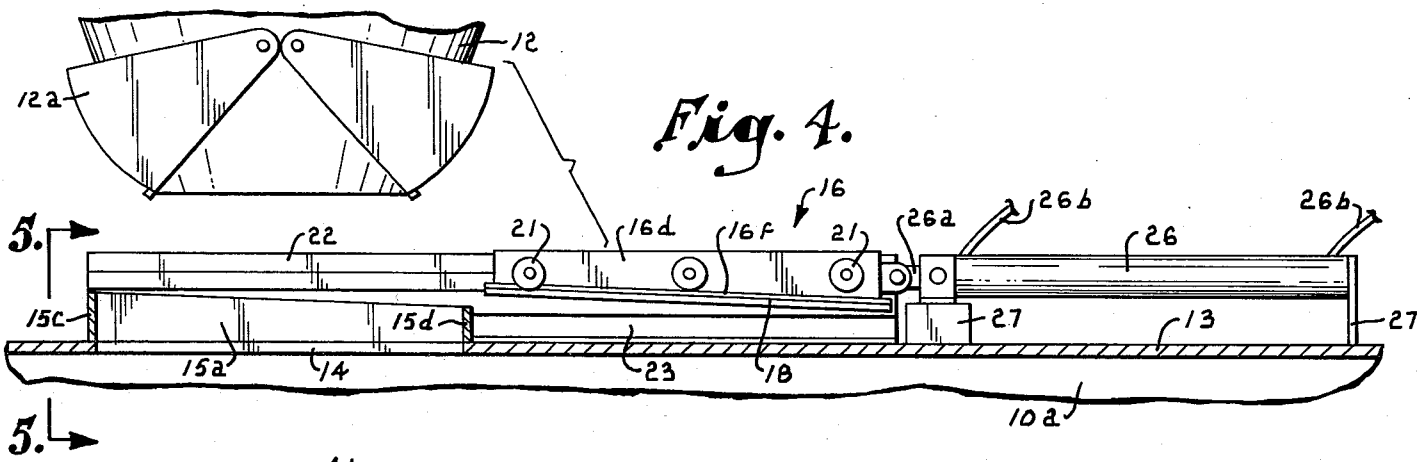
FIG. 4 is a side elevational view similar to FIG. 3 but showing the closure door in the open position, the support track has been removed to better illustrate the details of construction.
Figure 5:
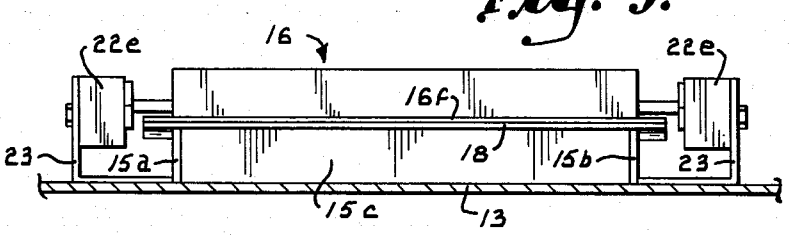
FIG. 5 is an end elevational view taken along line 5—5 of FIG. 3 in the direction of the arrows.

Interiorly of the track housing an elongate rail 24 which supports the grooved wheels 21 is mounted on brackets 25. A guide channel secured interiorly of the track housing overlies the wheels 21 to prevent derailment. As shown in FIG. 4, it should be noted that the roller wheels 21, as well as the track assemblies 22, are horizontally aligned and thus parallel to the plane of the bin roof 13.

To the rear of the closure door 16, a power cylinder 26 is mounted by brackets 27 to the cover 13 of the bin. The extendible arm 26*a* of the power cylinder is pinned to the rearward wall 16*c* of the closure door 16. The cylinder is also equipped with conventional hydraulic or pneumatic lines 26*b* to effectuate extension or retraction of the arm 26*a*.

When the door 16 is closed as shown in FIG. 3, the resilient gasket 18 overlies the flange walls 15*a–d* and the weight of the door itself causes the gasket 18 to seal the intake opening 14. The closure door 16 may be retracted from the position shown in FIG. 3 on its associated track assemblies 22 to an open position shown in FIG. 4 by retracting the extendible arm 26*a* of the power cylinder. The inclined attitude of the plane of the seal between the closure door 16 and the bin flange 15*a–d* greatly facilitates the retraction of the closure door 16 by overcoming the resistance of the temporary bond at the sealing edges.

In connection with the operation of the closure door 16, it should be obvious to those skilled in the art of system controls that control of the closure door 16 and control of the pulse feeder 12 or the conveyor 11 (if the conveyor is used alone) may be coupled to prevent the occurrence of hotmix being inadvertently dumped onto a closed door 16.

Figure 2:
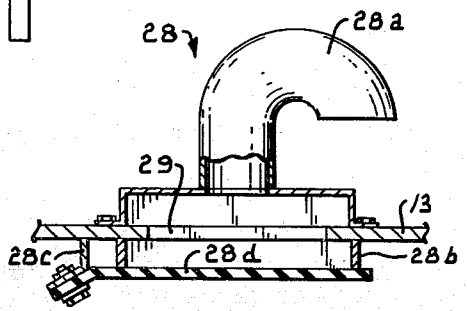
FIG. 2 is an enlarged sectional view of the check valve located atop the storage bin and taken along line 2—2 of FIG. 1 in the direction of the arrows.

Illustrated in FIG. 2 is a one way check valve 28 installed in the bin roof 13 to maintain atmospheric pressure within the storage bin 10. The valve 28 includes a generally U-shaped conduit 28*a* bolted to the top of the bin roof 13 to cover a vent opening 29 therethrough. Interiorly of the bin and surrounding the vent opening 29 is an upstanding collar section 28*b*. A bracket 28*c* welded to the bin cover 13 outwardly from the collar section 28*b* holds a check valve shutter 28*d* which is resiliently biased to cover the collar 28*b*. The shutter 28*d* therefore admits air through the conduit 28*a* to the interior of the bin 10 when atmospheric pressure exceeds the internal pressure of the bin by a predetermined amount.

The check valve 28 thus constructed admits atmospheric air into the upper region of the storage bin 10 when material is discharged and it eliminates the creation of a partial vacuum. Thus the demand for additional inert gas from an inert gas injection system in order to equalize the internal pressure is circumvented and any discharge problems and hazards to the structural integrity of the bin are likewise eliminated.

To prevent the bin 10 from becoming overpressurized, a relief valve 30 is installed in the bin cover 13 to vent the interior of the bin if the internal pressure exceeds atmospheric pressure by a predetermined level. For example, the relief valve 30 may be set to vent when the pressure exceeds one-half inch water gauge.

The gas injection system to supply inert gas to the storage bin 10 is schematically illustrated in FIG. 1. The inert gas itself should be a non-toxic, low reactive gas, such as carbon dioxide. Ideally, the inert gas should have a higher molecular weight than air to effectively blanket the exposed asphalt material within the storage bin.

The inert gas is supplied by a plurality of conventional gas bottles, such as 50 lb. industrial supply bottles. In the particular arrangement shown in FIG. 1, two alternative banks 31*a–b* of gas bottles are provided. With conventional piping and valves 32, the gas supply banks 31*a–b* are connected and used alternatively so that when the first bank exhausts its supply, the second bank can be employed while the supply to the first bank is replenished. Regardless of whether one or more banks are used, however, it is important that the particular bank supplying the inert gas be composed of a plurality of bottles connected in parallel to eliminate possibility of bottle freezing because of the rapid dispensing of the system during operation intervals.

The piping of each supply bank 31*a–b* is equipped with a gas regulator 33*a–b* and is connected through main valves 34*a–b* to a common manifold 35. The common delivery line 35 contains a flow indicator 36 and an electrically actuated solenoid control valve 37 through which gas is controllably delivered through line 35 to the interior of the bin via a pipe nipple 38.

Figure 7:
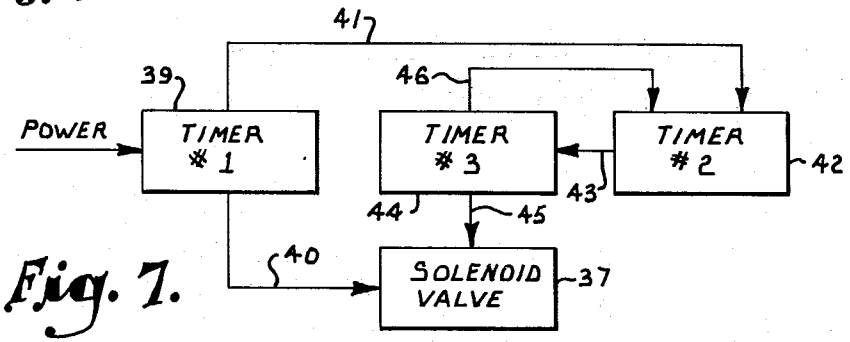
FIG. 7 is a block diagram of the electrically timed control for regulating the supply of inert gas to the storage bin.

The solenoid valve 37 is responsive to the programmable electric timing control circuit shown in FIG. 7. The control supervisor illustrated includes a first variable timer 39 which may be connected to a conventional power source and which delivers output signals through line 40 to the solenoid valve and through line 41 to a second variable timer 42. Output 43 from the second timer 42 is delivered to a third variable timer 44 which, through line 45, controls operation of the solenoid valve 37 and generates a reset signal 46 to the second timer 42.

So constructed, when the first timer 39 is switched on, the solenoid valve 37 is energized for the length of time set on said first timer. During this length of time, inert gas flows through the valve 37 and into the bin 10. At the expiration of the time set on the first timer 39, the solenoid valve 37 closes and the second timer 42 is turned on. The second timer 42 determines the length of time that the valve 37 remains closed. When the second timer 42 turns off, the third timer 44 is activated and the solenoid valve 37 is opend for the time determined by the third timer 44. When the third timer 44 turns off, the valve 37 closes and the second timer 42 is again activated. The cycle is thus continuously repeated until the control system is deenergized.

In actual plant operation, it is desirable to link activation of the first timer 39 with the opening of the closure door 16. Since first timer 39 is typically set to open the control valve 37 for a longer period of time than third timer 44, a larger quantity of inert gas is supplied to the bin when hotmix is delivered for temporary storage. During times when the hotmix is not being fed to the bin, a shorter burst of inert gas is supplied by the control of third timer 44 at regular intervals to maintain an effective inert gas blanket. By way of example, first timer 39 may be set to deliver a base charge of inert gas for 90 minutes, second timer 42 may be set to shut off gas flow for 4 hours, and third timer 44 may be set to deliver a maintenance dose of inert gas for 20 minutes.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. Asphalt storage facilities fed by asphalt delivery means, said storage facilities comprising in combination:

a storage bin including a sealable tank enclosed at the top with a horizontally disposed cover plate;

an intake port through said cover plate and having a flange mouth with an upper sealing edge lying in a plane inclined with respect to the horizontal plane of said cover plate;

a movable closure door mounted atop said cover plate and positionable in a closed position to overlie said intake port and to bear against the upper edge of said flange mouth in sealing engagement and positionable in an open position removed from said intake port to admit access to the interior of said storage bin a track housing extending along opposed sides of said flange mouth and having a resilient longitudinal shield which provides access to the interior of said housing;

a plurality of axles projecting outwardly from said closure door to penetrate said shield to the interior of said track housing;

a rail member secured interiorally of said track housing;

wheels mounted on the ends of said axles to roll upon said rail member whereby said closure door is supportingly carried between said open and closed positions; and power means coupled to said closure door to move said door between said open and closed positions.

2. The combination as in claim 1, said movable closure door including a bottom sealing plate inclined complementary to the upper sealing edge of said flange mouth.

3. The combination as in claim 1 including an inert gas injection system connected to said storage bin to supply inert gas to the interior thereof, and pressure equalizing valve means installed in said bin to restore atmospheric pressure to the bin whenever the internal pressure departs from atmospheric pressure more than a predetermined amount.

4. The combination as in claim 3, said pressure equalizing valve means including a pressure relief valve to vent the bin when the internal bin pressure exceeds atmospheric pressure more than a predetermined amount, and a check valve to admit outside air when the internal bin pressure drops below atmospheric pressure more than a predetermined amount.

* * * * *